United States Patent [19]

Bautz

[11] 4,404,634

[45] Sep. 13, 1983

[54] LATERAL WEAVE GAGING SYSTEM

[75] Inventor: James E. Bautz, Uplands, Calif.

[73] Assignee: Kaiser Steel Corporation, Oakland, Calif.

[21] Appl. No.: 257,921

[22] Filed: Apr. 27, 1981

[51] Int. Cl.[3] ..... G01B 7/34

[52] U.S. Cl. ..... 364/472; 364/507; 73/159; 83/365

[58] Field of Search ..... 364/472, 475, 507, 508, 364/552; 73/159, 579; 83/360, 364, 365, 367, 370

[56] References Cited

U.S. PATENT DOCUMENTS 3,703,097 11/1972 Kilpatrich et al. ..... 73/159
3,763,483 10/1973 Urmeny ..... 73/159
4,073,007 2/1978 Boivin ..... 364/472
4,309,902 1/1982 Sano et al. ..... 73/159

*Primary Examiner*—Gary Chin
*Attorney, Agent, or Firm*—James E. Toomey

[57] ABSTRACT

This invention relates to a detection system for determining the lateral weave or sinosoidal variation in the edges of a continuous strip of sheet metal during an uncoiling and coiling operation. The detection of the weave permits prompt corrective action to be taken. The system comprises an apparatus positioned along one edge of the line on which the coil is being processed after the sheet exits a rotary cutting knife. It operates to scan the edges of the sheet for lateral weave from the center line of the rotary shear.

6 Claims, 8 Drawing Figures

FIG. 1.
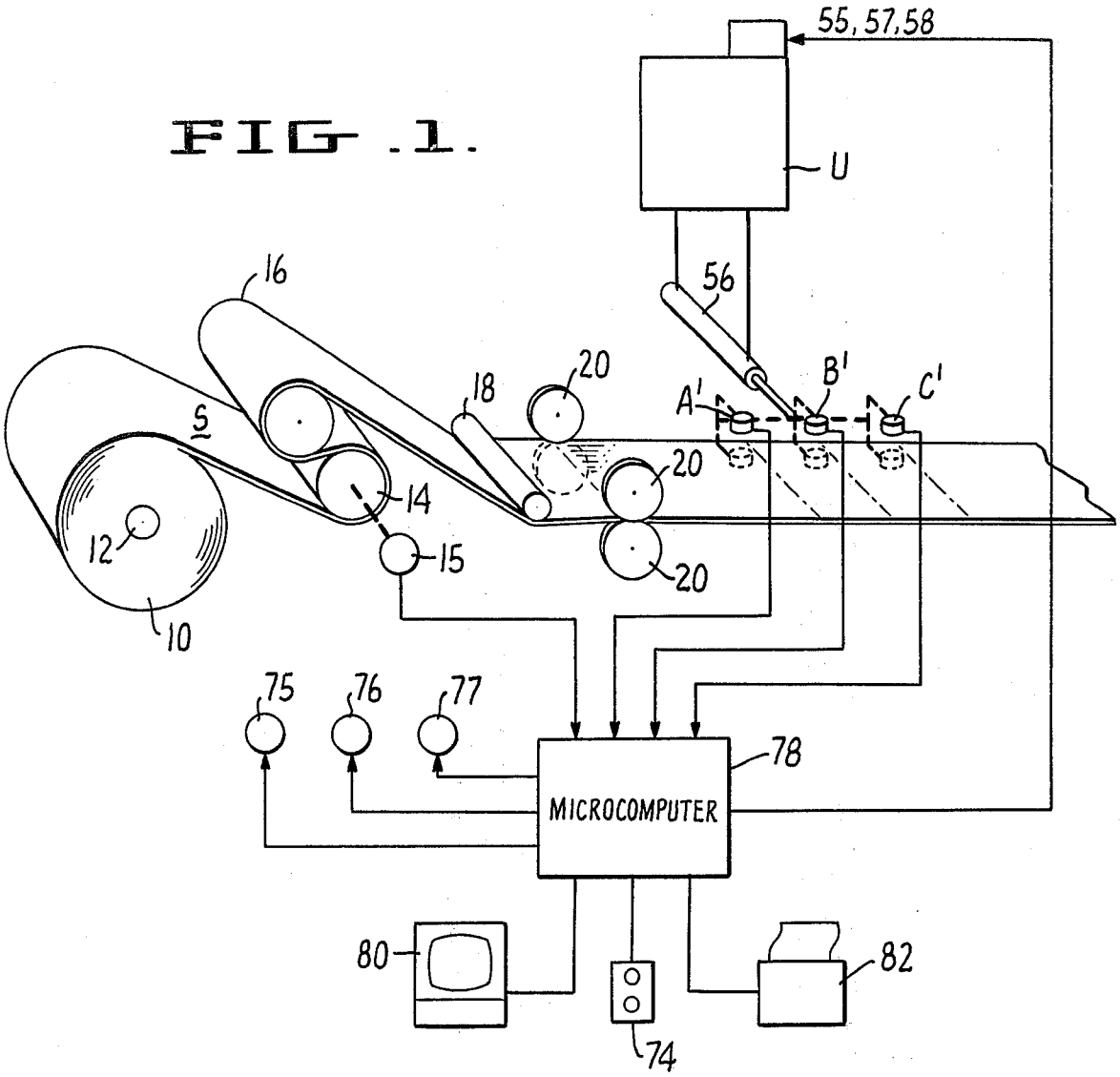
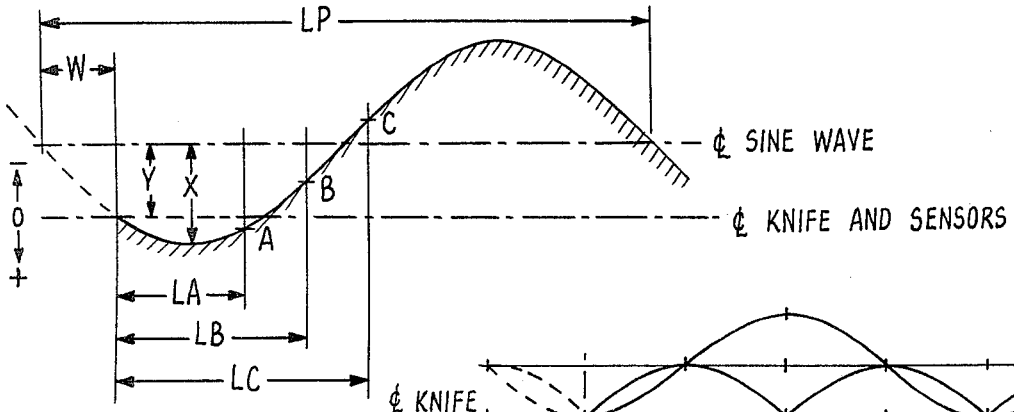
FIG. 2.
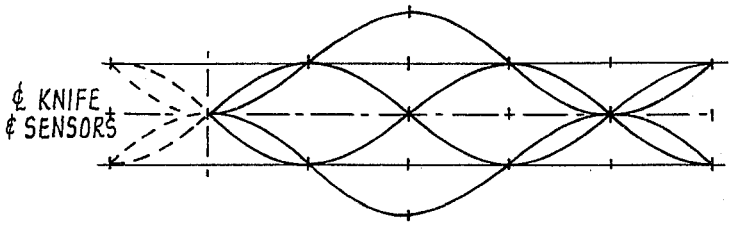
FIG. 3.

LATERAL WEAVE GAGING SYSTEM

BACKGROUND OF THE INVENTION

The present invention relates generally to an apparatus for measuring the amount of skew or sinusoidal variation in the edges of moving plates or sheet material. It is particularly intended for use in preparing steel sheet and strip for the manufacture of tin plate.

In the manufacture of tin plate from sheet and strip it is normal practice to subject a slab of steel to a hot rolling operation wherein rolling at the last finishing stand is conducted above the upper critical temperature of the metal. In such a hot rolling operation the strip is wound into a coil at temperatures ranging from 1050° to 1200° F., depending on the end use of the product and its desired metallurgical characteristics. The hot roll strip is then subjected to a continuous pickling operation wherein the strip first passes through cold working equipment which fragments surface scale and facilitates acid attack prior to actually passing through the pickling solutions at uniform speed to complete oxide removal, and is thereafter followed by cold water spray rinses and, if necessary, neutralizing alkaline solutions. The strip is then recoiled.

Following pickling, cold reduction of the coil takes place. The reduction in thickness of the strip may be as great as 90% and is carried out at exceedingly high rates of speed on the order of 1 mile per minute. Care must be exercised to obtain flat strip from the cold reduction mill in order to secure uniform results further on in the tinning process. Strip shape can be distorted by edge wrinkles or center buckles, most of which is caused by excessive uneven rolling pressures. Such distortion results in noncylindrical out of round coils of metal.

Prior to annealing the coils received from the coil reduction operation are uncoiled and subjected to electrolytic cleaning, rinsing and air drying and are thereafter recoiled. The strip may be annealed on a continuous line, which once again necessitates uncoiling and recoiling the strip at relatively high temperatures and line speeds.

The annealed strip may then be subjected to temper-rolling to secure the desired hardness and surface texture, to impart the required mechanical properties to the product made from the strip and to effect final flattening of the strip. Again, excessive rolling at the edge or center can cause edge or center fullness.

In the course of the foregoing operations the strip is coiled and uncoiled several times. Apart from any edge or center defects, improper recoiling can cause noncylindrical coils with resultant defects and reduced acceptance of the ultimate tin plate product.

A typical coil when treated in the foregoing operations may weigh from 30,000 to 40,000 pounds. Its length may be approximately 25,000 feet. It can be readily appreciated that handling such large units of product, with frequent coiling and uncoiling, can result in recovery of coils that are noncylindrical and undesirable.

In tin plate manufacture a coil preparation line is thus used for edge shearing and inspection of the strip at a location prior to the tin coating operation. As in prior operations, the coils of steel are placed on a motor driven mandrel and uncoiled through tension bridle rolls, side shears and then recoiled again on a motor driven mandrel while moving through the line at very high speeds such as 2400 fpm.

Noncylindrical coils when processed through the rotary side shear can result in edges on the strip which are not straight but instead have sinusodial variations. Such variations produce inferior product and can result in rejection of products and great loss to the manufacturer. Accordingly, installation of a measuring device on the coil preparation line to detect edge variations as the coil is sheared can be very advantageous and can provide information enabling corrective action to be taken before inferior products are produced. One useful arrangement is to locate the measuring system on the exit side of the side shears.

The lack of symmetry of an out of round coil and the sinusodial oscillations of the steel strip which result when it is unwound from the coil preparation line mandrel as it is fed into side trimmer knives are definite disadvantages. The amplitude of the oscillations tend to increase with the rotational speed of the mandrel and the strip speed. Such oscillations produce an alternating tension from side to side on the strip as it is fed into the shear, thus producing a sinusodial pattern of lateral weave cut into the sides of the strip by rotating shear knives. The period length of the sinusodial variation is dependent on the circumference of the payoff coil. When the edge of the strip deviates from a straight line over a given longitudinal length, that length of strip becomes unusable for prime tin plate products.

The purpose of this invention is to determine dynamically the maximum amplitude of the deviation from a straight line for a given wave length of strip, e.g. 0.025 inches in 5 feet. This is accomplished by taking three separate lateral measurements along the edge of the strip along with a measurement of wave length and thereupon calculating maximum amplitude of the lateral variations.

SUMMARY OF THE INVENTION

This invention relates to a lateral detection system for determining the skew or sinusoidal variation of the edges of a continuous strip of sheet metal during an uncoiling and coiling operation in order that prompt corrective action can be taken. The system comprises an apparatus positioned along one edge of the processing line after the sheet material exits a rotary cutting knife. It operates to scan the edges of the sheet for lateral weave from the cutting line of the rotary shear. The system discriminate between lateral movement of the strip and true edge geometry.

The equipment comprising the detection system is entirely independent and separate from the processing line along which the strip travels. It is on rigid supports and mounted upon it is a carriage having rigid frames supporting horizontally moveable shafts, each of which have sensors on their ends adjacent the line for recording the location of the edge of the sheet material. The carriage on which the sensors are mounted may be moved into and out of a scanning position. An electro-hydraulic actuating system, a data storage means, computing means, and signal means for noting the operating mode of the system, are utilized to control the operation of the system.

DESCRIPTION OF THE DRAWINGS

The problem solved by the present invention and the means for carrying out the system can be more readily understood by reference to the accompanying drawing wherein:

FIG. 1 is a diagrammatic representation of the apparatus employed in detecting and measuring the system of the invention;

FIG. 2 is an illustration of the geometry of a typical wave pattern representing one edge of the strip and in fact represents a top plan view of the edge of the sheet along the length of a sine wave;

FIG. 3 is a representation of four different phase patterns of the lateral weave variations for single wave length and amplitude of one edge of strip as it is generated by the shear knives;

DETAILED DESCRIPTION OF THE INVENTION

Figure 5:
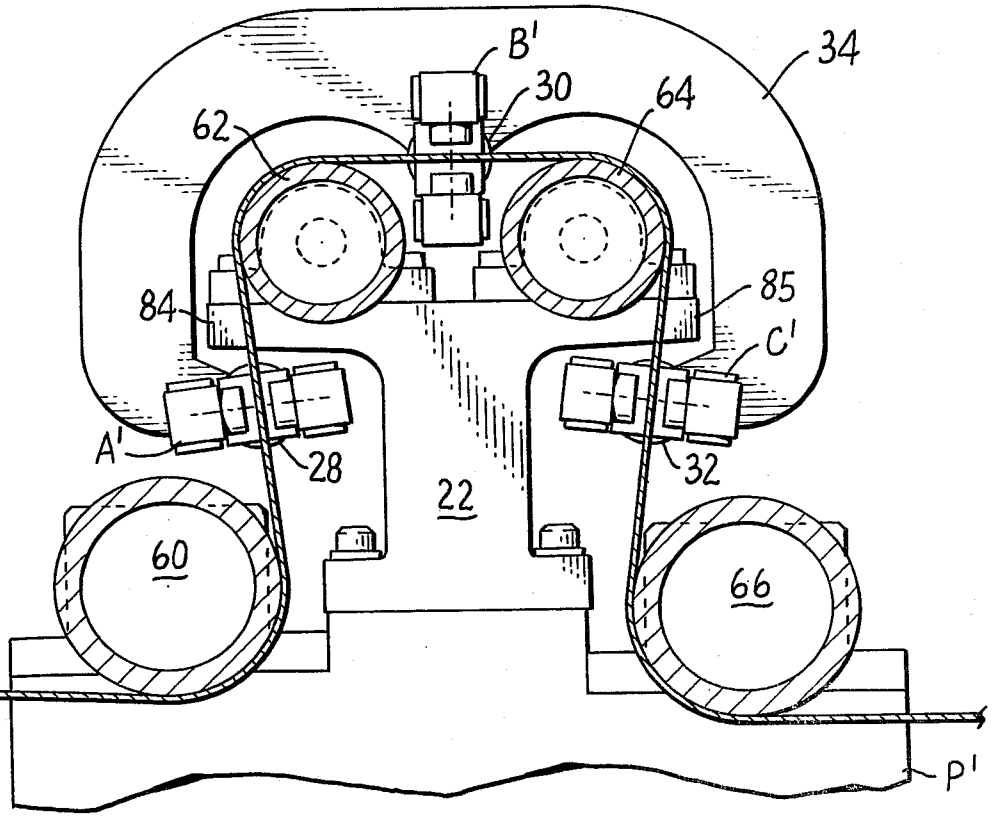
FIG. 5 is a view partly in section taken along line 5—5 of FIG. 4 looking in the direction of the arrows and showing the positions and mounting of the rolls and the sensors and the path of the strip.

A preferred embodiment of the measuring system of the invention is disclosed hereinafter. It is advantageously located on the exit side of the side shear. As will be noted from FIG. 1 of the system in the embodiment disclosed, strip S is mounted on mandrel 12 in the form of coil 10 which is payed off and passed through motor drive bridle rolls 14 and 16 and over guide roller 18 into rotary shear knives 20.

Although the detector system is show schematically in FIG. 1, the structure and arrangement of the principal parts of an advantageous embodiment of the detection system are shown in detail in FIGS. 4–7. The principal parts of the detection system are the sensors A' B' and C' heretofore mentioned and to be described later in more detail, the moveable carriage for the sensors and the rigid frames and supports upon which the carriage is mounted.

Figure 4:
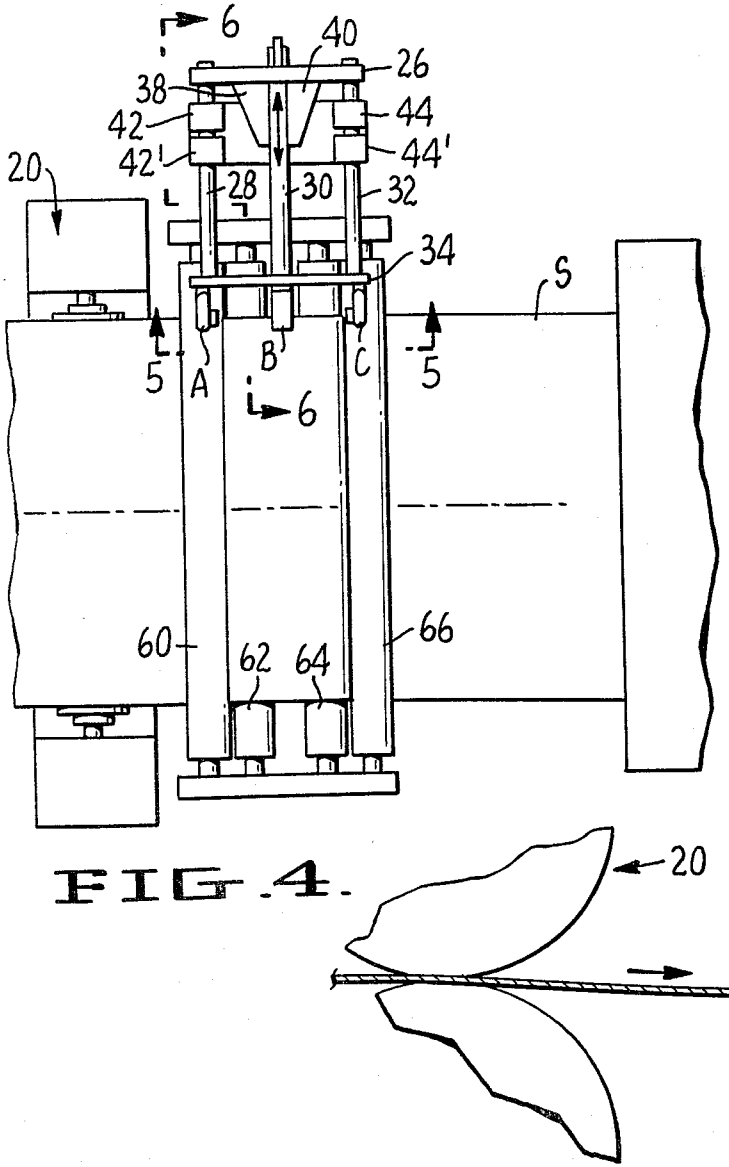
FIG. 4 is a plan view of the principal portion of the weave detector system, including edge shears, rolls and sensor devices.

As will be noted from FIGS. 1, 4 and 5 the detection system is located after the rotary edge shears 20. The sensors A', B' and C' are arranged so that they scan one edge of strip S as it leaves the edge shears when the sensors are in the operative position or the carriage on which they are mounted can be retracted to a position spaced away from the strip edge where the sensors are inoperative.

Figures 6, 7:
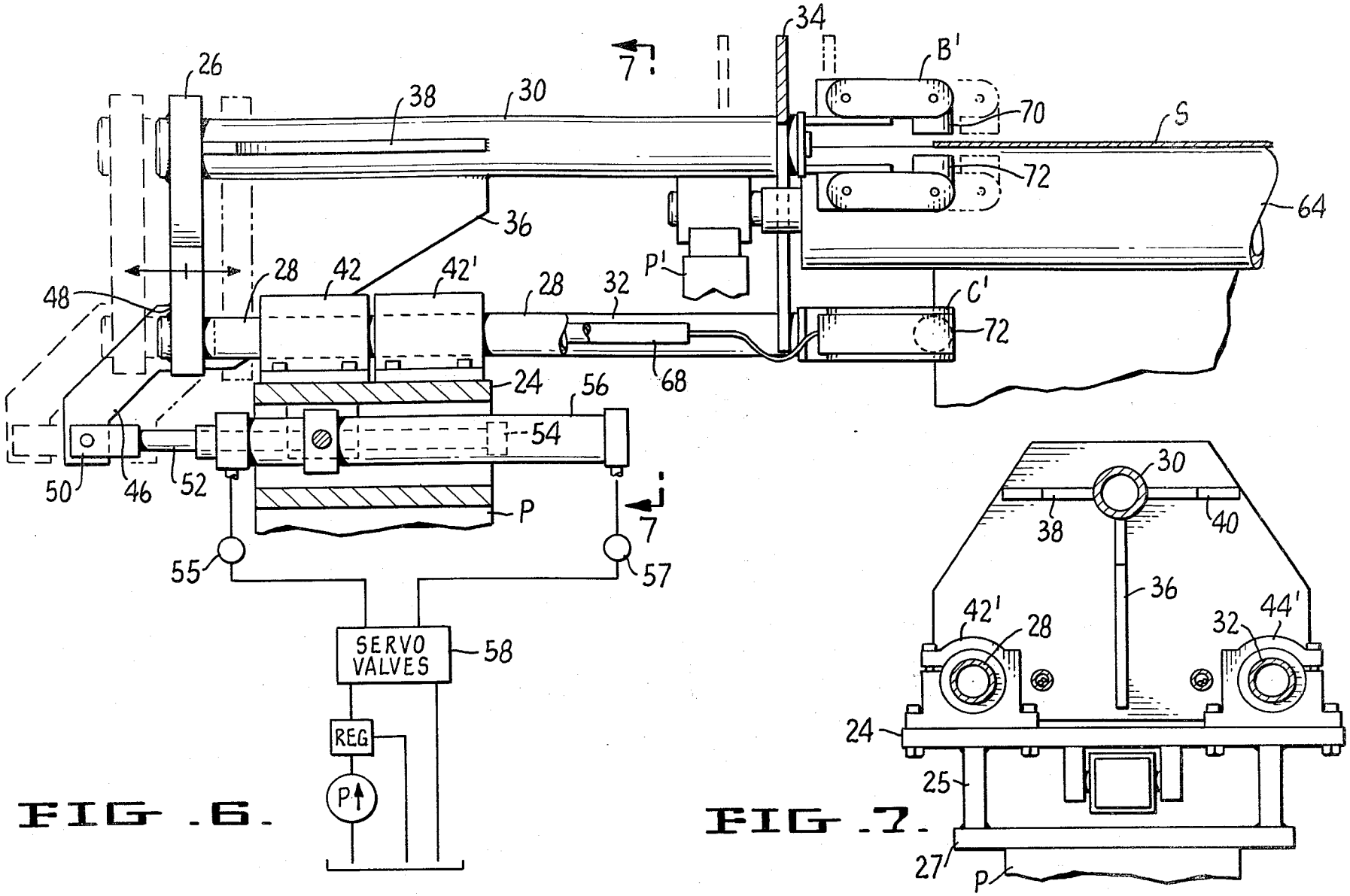
FIG. 6 is a fragmentary view partly in section taken along line 6—6 of FIG. 4 looking in the direction of the arrows showing the sensors and the supporting shafts and table upon which they are mounted.
FIG. 7 is a partial end view taken along line 7—7 of FIG. 6 looking in the direction of the arrows and showing the back plate and other supporting means for the sensors.

As will be seen from FIG. 4 the detection system is mounted and supported on one side of the line. Pedestal P which is anchored at its base serves as the principal support means for the carriage and sensors of the detector system. Carriage R and its main components are best shown in FIG. 6 and FIG. 7. Carriage R comprises a base plate 24 which is supported by upstanding lateral flanges 25 that desirably extend the length of supporting table 27 to which they are affixed. Table 27 is mounted on Pedestal P which is anchored at its base and serves as the prime support for the detector system. Table 27, lateral supporting flanges 25 and base plate 24 are fixedly connected to each other by weldments, or by nut and bolt means or the like to assure permanent joints. Advantageously they are made of heavy steel plate to provide the strength required for rigid support of the system.

Back plate 26 is arranged vertically at the back end of the carriage and serves as the support means at that area for sensor shafts 28, 30 and 32. A C-shaped plate or yoke 34 is positioned at the opposite ends of sensor shafts 28, 30, 32, immediately adjacent sensors A', B', and C', respectively. The shafts and sensors are arranged in a generally triangular relationship and sensors A', B', and C' are spaced equal distances from each other as will be noted from FIGS. 5 and 7. Backplate 26 and upper sensor shaft 30 are reinforced and strengthened by gusset plates 36, 38 and 40 and furnish the cantilever support required for shaft 30 and C-shaped yoke or plate 34 to which shaft 30 is connected at its opposite end and also supports shafts 28 and 32 at their ends adjacent to the sensors.

Shaft 28 is mounted within bushings or journal bearing housings 42 and 42' and shaft 32 is mounted within journals 44 and 44'. Shafts 28 and 32 are on a lower horizontal plane than shaft 30 and are adapted to reciprocate within the bearings 42, 42' and 44, 44' which are bolted or otherwise permanently affixed to table 27. Bracket arm 46 is connected at one of its ends at point 48 to the base of backplate 26 and at its opposite end at 50 to the projecting end of piston rod 52. The end of rod 52 is connected to a plunger or a piston 54 which reciprocates within cylinder 56. Servo valves 58 form part of the detector carriage power and control unit U, to be described in more detail and actuates cylinder 56 and piston rod 52 and bracket arm 46. Closure valves 55 and 57 are placed in the lines from servo-valves 58 to cylinder 56 to control the flow to the cylinder.

C-Frame 34 moves toward and away from the edge of strip S with the reciprocating movement of shafts 28, 30 and 32 to which 34 is permanently joined and forms part of carriage R.

Sensors A', B', and C' are mounted at the ends of each of the sensor rods or shafts 28, 30 and 32, respectively, which shafts as previously described and as shown in FIG. 5 and FIG. 6, are also mounted on rigid C frame or yoke 34 at their ends adjacent to the edge of the line where strip S passes and is to be scanned. Each sensor comprises a photo-optical pair. In this instance the devices each comprise photo-electric cell means consisting of a photo-detector 70 and light source 72. Electric power and sensor signals are transmitted to and from the sensors through wiring 67 which is housed within utility conduit 68. It is to be understood that any conventional photo-optic equipment or other means for scanning the edges or lines of strip or sheet or the like can be used for this purpose. Such equipment is well known to those skilled in the art.

Sensors A', B', and C' are so constructed and arranged that the beam or other light source projected from one element of the photo-optical pair to the other element is generally perpendicular to the strip at the point at which the strip edge is to be scanned. It will be noted (FIG. 6) from the dotted lines that the sensors A', B', and C' can be moved into and out of an operative position by movement of the carriage R. Pedestal P and carriage R, including its supporting table, C-frame and back plate and gusset plates, all cooperate to provide a rigid support for the sensor that is independent of the strip processing line and other equipment.

A cluster of rolls, 60, 62, 64 and 66, is arranged in cooperative relationship with sensors A', B' and C' to enable strip S to pass through the detection system. Such a cluster arrangement minimizes the distance occupied by the detection system and tends to minimize vertical movement (fluttering) of the strip edge. Rolls 60 and 66 are at the base of the cluster and are supported at their ends adjacent to the carriage by an independent pedestal P' upon which conventional journal bearings are mounted. Similar support means are placed at the opposite ends of rolls 60, 62 and 64 and 66 opposite the detector system. As shown in FIG. 5 rolls 62 and 64 are supported by a frame 22, previously identified, which is bolted at its base P' and has projecting arms 85 at its top upon which mounts and bearings 84 for each of the rolls are mounted. Rolls 62 and 64 are at a level above the entry and exit rolls of the cluster.

Figure 8:
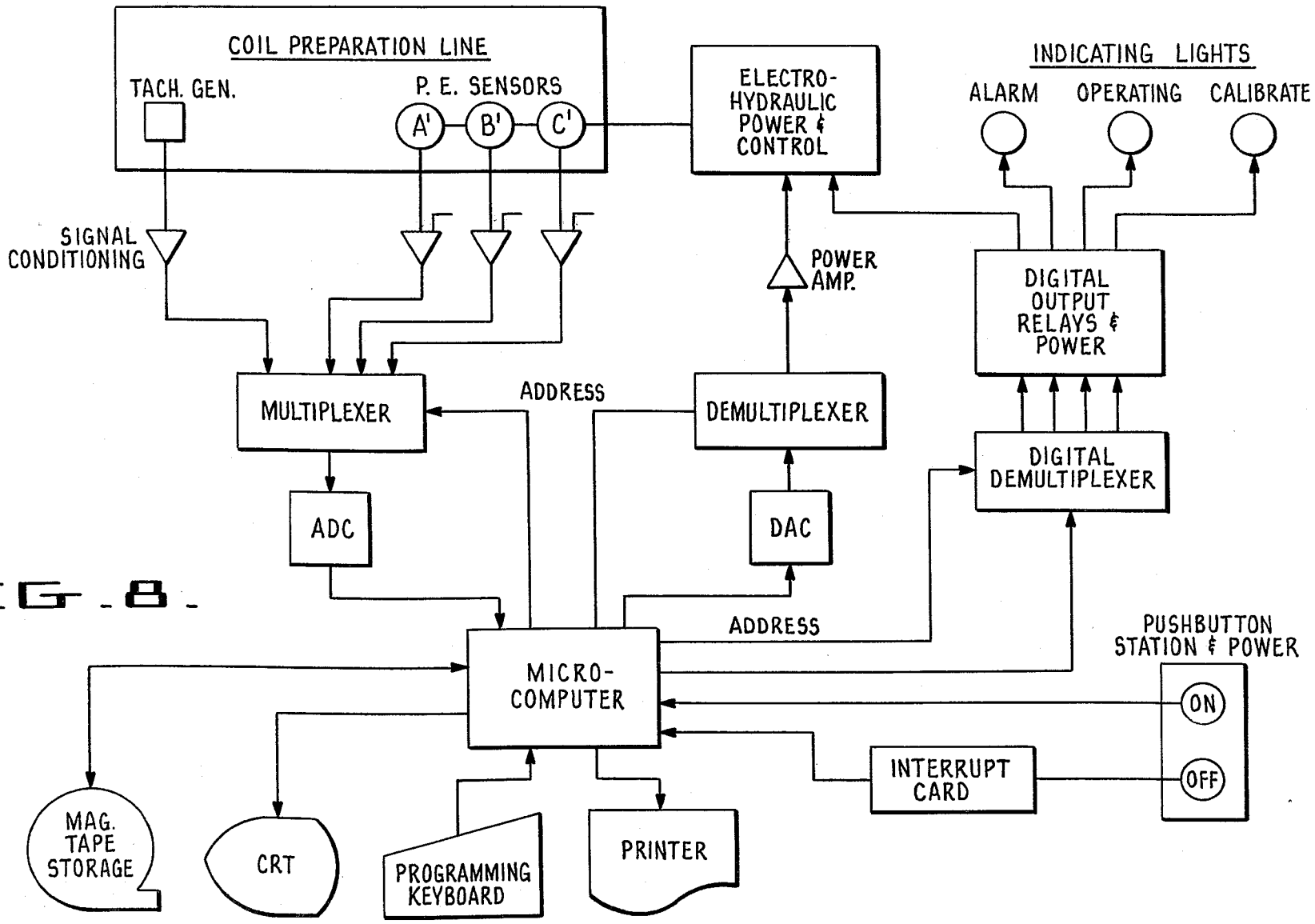
FIG. 8 is a schematic diagram of the electrical system of the invention.

The measuring system and other hardware employed in the detection system as shown in FIGS. 1 and 8 of the invention comprise on-off push button station 74 for starting and stopping the operation, three color indicating lights 75, 76, 77 to show system status, a microcomputer 78, a cathode ray tube (CRT) and keyboard 80 and a printer 82, sensors A', B' and C' and tachometer generator 15. The circuitry for the foregoing components, as will be apparent from FIG. 8 and the description below, is so designed that when the switch is in the "on" position and the sensors are directly over the strip edge the microcomputer 78 receives signals from tachometer generator 15, and edge sensors A', B', and C', readings are sent to the microcomputer 78 which in turn can transmit signals to alarm light 75, operating light 76 and calibrating light 77. Microcomputer 78 also can transmit signals to cathode ray tube and keyboard 80 and to printer 82. Microcomputer 78 also is adapted to furnish signals to the servo valve 58 and power control unit U, which in the present embodiment consists of a motor driven hydraulic pump, locking solenoid shutoff valves and pressure relief valves.

One form of electrical system for the control equipment and other apparatus of the invention is shown schematically in FIG. 8. As will be seen the signals generated by the tachometer generator and photo-electric sensors are transmitted through signal conditioning means prior to introduction to the input portion of the computer complex. The latter system comprises a multiplexer for selectively receiving and handling the signals which then are fed to the analog to digital converter (ADC) for conversion before entry into the microcomputer which serves as the central processor unit for the entire system.

The microcomputer is in direct communication with a tape storage or program storage unit, a cathode ray tube display unit, a programming keyboard for direct access and a printer for reviewing additional readable output from the central processor unit. Manual pushbutton units are connected directly to the microcomputer to control its operation along with interrupt card means for instant shutoff.

The output side of the computer complex comprises a digital-analog converter (DAC) with an associated demultiplexer and a digital demultiplexer for receiving signals from the microcomputer. The signals passing through the DAC and its associated demultiplexer are passed through a power amplifier on to the electro-hydraulic servo valve for operation of the sensor shafts as required to accomplish the objects of the invention. The signals from the digital outputs are transmitted directly to the indicating lights to show the operating mode of the invention. The digital signals are also fed to the solenoid shutoff valves.

In the present embodiment of the invention rotary edge shears 20 and the reading point on the processing line for sensor A' are spaced 30 inches apart, the point for sensor B' is spaced 15 inches from A', i.e., 45 inches from the edge shears 20, and the point for sensor C' is spaced 15 inches from B', i.e., 60 inches from edge shear 20.

In operation the sensors A', B' and C' are maintained retracted in an inoperative position until the line is threaded with strip S in the normal manner as shown in FIG. 1. Switch 74 is turned on signaling the computer to actuate a calibration light 77 and move sensors A', B' and C' toward the strip edge. The movement of the sensors is effected by a signal from the microcomputer to operate the servo valve 58, and shutoff valves 55 and 57 which actuate hydraulic cylinder 56. Piston rod 52 then causes bracket 46 to move back plate 26 mounted on carriage R to which sensor shafts 28, 30 and 32 are connected and thus moves the sensors to an operative position.

When sensor A' detects the strip edge as it partially blocks its photo-cell light source 72, microcomputer 78 signals carriage R to stop. When the strip reaches a specified minimum speed as indicated to microcomputer 78 by the output from tachometer generator 15, the computer reads sensor A' for a specified time interval. This interval is selected so that the longest period with minimum strip speed can be scanned through its entire cycle. By selecting the maximum and minimum readings from sensor A' and totaling them an error signal is generated by the computer. This signal is then transmitted to servo valve 58 which will move carriage R in a direction that will cause the error to decrease to a minimum thus stopping the carriage with all sensors A', B' and C' in a straight line with shear knife edge 20. The foregoing completes the calibration sequence and computer 78 transfers immediately into an operating mode by switching off solenoid valves 55 and 57, the calibration signal 77 and turning on the operating signal 76.

Sensor A' scans the edge of the sheet passing through the line and tachometer 15 records the speed of the sheet through the line, all of which values are reported to and stored in microcomputer 78. By measuring the time lapse wherein the values for three consecutive readings of Sensor A' are at an absolute minimum or zero, i.e. three successive detections of the edge of the strip relative to a reference point as it moves by the sensor, it is possible to thus measure a complete sine wave period in the edge geometry of the strip. The computer thereupon scales the tachometer voltage into inches per second and calculates average line speed. From the measured time period and the average line speeds the computer thereupon calculates the period length of the edge variation.

The three edge sensor A', B' and C' are scanned by the computer and checked against a maximum limit to insure that they are not beyond their range and the voltages are thereupon scaled into units of displacement, e.g. inches, by the computer using a fifth order polynomial.

From the three lateral displacements and the period length, the phase shift and maximum lateral weave amplitude is calculated by any two of the following three equations:

$$X = \frac{A - B}{\text{SIN}\,\frac{2\pi\,(W + 30)}{LP} - \text{SIN}\,\frac{2\pi\,(W + 45)}{LP}}$$

$$X = \frac{B - C}{\text{SIN}\,\frac{2\pi\,(W + 45)}{LP} - \text{SIN}\,\frac{2\pi\,(W + 60)}{LP}}$$

$$X = \frac{A - C}{\text{SIN}\,\frac{2\pi\,(W + 30)}{LP} - \text{SIN}\,\frac{2\pi\,(W + 60)}{LP}}$$

Where "X" is the sine wave maximum amplitude, "A", "B", and "C" are the sensor readings, "W" is the phase shift and "LP" is the period length. The constants 30, 45 and 60 are the distances in inches from the center line of the shear to the A', B' and C' sensors respectively.

After the value of the sine wave maximum amplitude (X) is determined it is divided by the period length (LP) and compared with the stored value of acceptable lateral weave. If greater than the stored value an alarm condition is indicated to the operator through light signal 75 so that corrective action can be taken as required; i.e. slowing the line speed. In a typical operation on a regular two second interval the computer 78 will send to CRT 80 the most recent maximum values of per unit lateral weave, maximum lateral weave, period length and average line speed.

Upon completion of the coil a complete history of lateral weave parameters for the coil will be printed out to be used for future analysis and decision making. The sensors meanwhile are retracted from the strip by turning switch 74 to the "off" position whereby computer 78 is interrupted and sends an analog voltage to servo valve 58 and digital signal to solenoid valves 55 and 57 to move the carriage R off line.

A more specific derivation of the equations, with particular reference to FIG. 2 is set out below wherein the definitions for the letter symbols are as follows:

X=Maximum amplitude of sinusoidal variation
W=Phase displacement of sine function from zero reference point (center line of shear)
LP=Length of period for sine function
A=Lateral displacement of strip from center line of knife at a distance "LA" from the zero reference (center line of shear)
B=Lateral displacement of strip from center line of knife at a distance "LB" from the zero reference (center line of shear)
C=Lateral displacement of strip from center line of knife at a distance "LC" from the zero reference (center line of shear)
LA=30 inches from center line of shear
LB=45 inches from center line of shear
LC=60 inches from center line of shear
Y=Lateral displacement of sine wave from center line of knife $Y = X\,\text{SIN}\,\frac{2\pi\,W}{LP}$ Lateral displacement of sine wave from center line of knife -continued $A + Y = X\,\text{SIN}\,\frac{2\pi\,(W + LA)}{LP}$ Lateral displacement of sine wave at distance "LA" from center line $B + Y = X\,\text{SIN}\,\frac{2\pi\,(W + LB)}{LP}$ Lateral displacement of sine wave at distance "LB" from center line $C + Y = X\,\text{SIN}\,\frac{2\pi\,(W + LC)}{LP}$ Lateral displacement of sine wave at distance "LC" from center line

SUBSTITUTE "Y" IN THREE EQUATIONS $$A = X\,\text{SIN}\,\frac{2\pi\,(W + LA)}{LP} - X\,\text{SIN}\,\frac{2\pi\,W}{LP}$$

$$B = X\,\text{SIN}\,\frac{2\pi\,(W + LB)}{LP} - X\,\text{SIN}\,\frac{2\pi\,W}{LP}$$

$$C = X\,\text{SIN}\,\frac{2\pi\,(W + LC)}{LP} - X\,\text{SIN}\,\frac{2\pi\,W}{LP}$$

THEN SUBTRACTING EQUATIONS $$A - B = X\,\text{SIN}\,\frac{2\pi\,(W + LA)}{LP} - X\,\text{SIN}\,\frac{2\pi\,(W + LB)}{LP}$$

$$B - C = X\,\text{SIN}\,\frac{2\pi\,(W + LB)}{LP} - X\,\text{SIN}\,\frac{2\pi\,(W + LC)}{LP}$$

$$A - C = X\,\text{SIN}\,\frac{2\pi\,(W + LA)}{LP} - X\,\text{SIN}\,\frac{2\pi\,(W + LC)}{LP}$$

By eliminating terms in any two of the three above equations it is possible to obtain:

$$W = \frac{LP}{2\pi}\,\text{TAN}^{-1}\,\frac{(B - C)\text{SIN}\,\frac{2\pi\,LA}{LP} + (C - A)\text{SIN}\,\frac{2\pi\,LB}{LP} + (A - B)\text{SIN}\,\frac{2\pi\,LC}{LP}}{(C - B)\text{COS}\,\frac{2\pi\,LA}{LP} + (A - C)\text{COS}\,\frac{2\pi\,LB}{LP} + (B - A)\text{COS}\,\frac{2\pi\,LC}{LP}}$$

NOW WE CAN SUBSTITUTE "W" BACK INTO THE FIRST EQUATIONS USING A, B, & C AND OBTAIN "X"

THUS $$X = \frac{A - B}{\text{SIN}\,\frac{2\pi\,(W + LA)}{LP} - \text{SIN}\,\frac{2\pi\,(W + LB)}{LP}}$$

$$X = \frac{B - C}{\text{SIN}\,\frac{2\pi\,(W + LB)}{LP} - \text{SIN}\,\frac{2\pi\,(W + LC)}{LP}}$$

$$X = \frac{A - C}{\text{SIN}\,\frac{2\pi\,(W + 30)}{LP} - \text{SIN}\,\frac{2\pi\,(W + 60)}{LP}}$$

As will be seen from the foregoing, the system discriminates between lateral movement of the strip and true edge geometry.

The embodiment of the invention described hereinabove is for use in connection with steel sheet or strip intended for use in tin plate operations. However, it is to be understood that it may be used in connection with other steel sheet processing operations, as well as other metals, such as aluminum, and other materials such as paper, where similar problems are encountered and must be overcome.

While a preferred embodiment of the invention has been disclosed herein, the claims set out below are intended to embrace all embodiments which fall within the spirit and scope of the invention.

What is claimed is:

1. Apparatus for determining sinusoidal variations in the edges of moving sheet metal as the sheet metal is passed from uncoiling means, subjected to on-line processing conditions while in flat form and while moving at a high rate of speed, and rewound in coil form, comprising, means for measuring the line speed of said moving sheet, sensor means located at three fixed spaced locations along the edges of said sheet and adapted to detect lateral displacement of said sheet edges within the plane of the sheet from a reference line in the form of sine waves, means for measuring the time period for each said complete sine wave whereby the period length of each said sine wave can be determined based on said time period and said line speed, and means for determining the maximum amplitude of each said sine wave based on said time period and said detected lateral displacement at said three fixed spaced locations.

2. The apparatus of claim 1 wherein the phase shift of said sine wave from a reference point and maximum lateral variation amplitude of said sine wave is calculated by solving any two of the following 3 equations:

$$X = \frac{A - B}{\frac{\text{SIN } 2\pi (W + 30)}{LP} - \frac{\text{SIN } 2\pi (W + 45)}{LP}}$$

$$X = \frac{B - C}{\frac{\text{SIN } 2\pi (W + 45)}{LP} - \frac{\text{SIN } 2\pi (W + 60)}{LP}}$$

$$X = \frac{A - C}{\text{SIN } \frac{2\pi (W + 30)}{} - \text{SIN } \frac{2\pi (W + 60)}{}}$$

wherein the definitions for the letter symbols are as follows:

X=Maximum amplitude of sinusoidal variation

W=Phase displacement of sine function from zero reference point (center line of shear)

LP=Length of period for sine function

A=Lateral displacement of strip from center line of knife at a distance "LA" from the zero reference (center line of shear)

B=Lateral displacement of strip from center line of knife at a distance "LB" from the zero reference (center line of shear)

C=Lateral displacement of strip from center line of knife at a distance of "LC" from the zero reference (center line of shear).

3. A method of detecting the sinusoidal variation in the edges of a moving strip of metal, comprising the steps of measuring the line speed of the moving strip;

measuring the lateral displacement of the edge of the strip from a reference line at three spaced locations along the strip;

measuring the time period of a complete sine wave resulting from a variation in the edge geometry of said moving strip of metal;

determining the period length of the said sine wave from said measured time period and said line speed;

determining the maximum amplitude of the said sine wave and the lateral weave in the edge geometry from said three lateral displacement measurements and said period length;

comparing the determined maximum lateral weave with an acceptable value of lateral weave; and indicating an alarm condition when the determined lateral weave exceeds the acceptable value.

4. The method of claim 3 wherein the time period of a sine wave is measured by detecting the length of time between three consecutive absolute minimum readings at one of said lateral displacement measuring locations.

5. The method of claim 3 further including the steps of indexing three spaced sensors into operative relationship with the edge of the strip, scanning the output signal from at least one of the sensors, summing the maximum and minimum values in the sensor output signal to generate an error signal, and adjusting the position of the sensors relative to the strip edge until the error signal is at a minimum and said sensors are thereby aligned with said reference line.

6. The method of claim 5 wherein said scanning takes place for an interval determined by the length of time it takes to scan the longest distance for an expected sine wave period at a minimum strip speed.

* * * * *